US009375943B2

(12) United States Patent
Hunter et al.

(10) Patent No.: US 9,375,943 B2
(45) Date of Patent: Jun. 28, 2016

(54) POST-APPLICATION INK PROCESSING AND SHEET HANDLING

(71) Applicant: Xerox Corporation, Norwalk, CT (US)

(72) Inventors: Jonathan B. Hunter, Marion, NY (US); James Joseph Spence, Honeoye Falls, NY (US); Mark A. Atwood, Rush, NY (US)

(73) Assignee: Xerox Corporation, Norwalk, CT (US)

( * ) Notice: Subject to any disclaimer, the term of this patent is extended or adjusted under 35 U.S.C. 154(b) by 283 days.

(21) Appl. No.: 13/677,045

(22) Filed: Nov. 14, 2012

(65) Prior Publication Data

US 2014/0132683 A1 May 15, 2014

(51) Int. Cl.

| | |
|---|---|
| ***B41J 2/01*** | (2006.01) |
| ***B41J 2/175*** | (2006.01) |
| ***B41J 11/00*** | (2006.01) |
| ***B41J 29/377*** | (2006.01) |

(52) U.S. Cl.
CPC ..... *B41J 2/17593* (2013.01); *B41J 11/002* (2013.01); *B41J 29/377* (2013.01)

(58) Field of Classification Search
CPC ..... B41J 2/17593; B41J 11/002; B41J 29/377
USPC ..... 347/102, 101, 104
See application file for complete search history.

(56) References Cited

U.S. PATENT DOCUMENTS

| | | | | |
|---|---|---|---|---|
| 5,835,835 | A * | 11/1998 | Nishikawa et al. | 399/328 |
| 8,248,640 | B2 * | 8/2012 | Tanaka et al. | 358/1.15 |
| 2002/0027587 | A1 * | 3/2002 | Sugaya et al. | 347/104 |
| 2011/0206403 | A1 * | 8/2011 | Kaneko et al. | 399/69 |

* cited by examiner

*Primary Examiner* — Henok Legesse
(74) *Attorney, Agent, or Firm* — BudzynFortunato IP Law, LLC

(57) ABSTRACT

An apparatus including a control cylinder rotatably supported for thermal conduction to a sheet. The sheet conveys ink deposited on a first side. The sheet is held against a peripheral arch of the control cylinder as it rotates with the first side of the sheet directly engaging and wrapping around the control cylinder along the peripheral arch. The apparatus also includes a thermal control element for heating and/or cooling the control cylinder. The apparatus also includes a pressure roll for spreading the ink. The pressure roll with the control cylinder forms a spreader nip, which is selectively changeable between a closed and open position. In the closed position the pressure roll is biased toward the control cylinder for applying pressure to the ink on the sheet. The pressure roll is spaced further away from the control cylinder in the open position relative to the closed position.

22 Claims, 9 Drawing Sheets

POST-APPLICATION INK PROCESSING AND SHEET HANDLING

TECHNICAL FIELD

The presently disclosed technologies are directed to apparatus and methods used to handle substrate media in a marking device using solid ink jetted onto the substrate media. The apparatus and methods described herein integrate cooling, spreading and duplex inversion of cut-sheets after ink has been applied thereto.

BACKGROUND

Ink jet marking devices that use solid ink print processes generally involve melting the solid ink and jetting it onto a substrate media sheet. The sheet carrying the ink must go through a cooling process while the ink is spread and leveled on the sheet as it is fixed thereon. Generally this process is performed by using several separate serial subsystems downstream of the marking station. Additionally, when printing onto substrate media in the form of individual cut-sheets, it is often desirable to flip the sheet over for duplex printing.

Accordingly, it would be desirable to provide an apparatus and/or method that combines the function of cooling, spreading and duplex inversion of cut-sheets in an integrated, compact, modular and scalable arrangement.

SUMMARY

According to aspects described herein, there is disclosed an apparatus for processing ink applied to a substrate media sheet, the apparatus including a control cylinder rotatably supported for thermal conduction to a sheet of substrate media. The sheet conveys ink deposited on a first side thereof. The sheet is held against a peripheral arch of the control cylinder as the control cylinder rotates with the first side of the sheet directly engaging and wrapping around the control cylinder along the peripheral arch. The apparatus also includes a thermal control element for at least one of heating and cooling the control cylinder. The apparatus also includes a pressure roll for spreading the ink. The pressure roll together with the control cylinder forms a spreader nip. The spreader nip is selectively changeable between a closed position and an open position. In the closed position the pressure roll is biased toward the control cylinder for applying pressure to the ink on the sheet. The pressure roll is spaced further away from the control cylinder in the open position relative to the closed position.

Additionally, the apparatus further includes an acquisition nip disposed adjacent the spreader nip for holding the sheet after the sheet passes through the spreader nip. The acquisition nip moves the sheet at least partly through the spreader nip in the open position. The pressure roll moves away from the control cylinder after a trailing edge of the substrate media sheet disengages the pressure roll. This allows the substrate media sheet to pass between the pressure roll and the control cylinder without further engaging the pressure roll. A rotational velocity of the control cylinder is adjustable for regulating a dwell time in which the substrate media sheet remains in direct engagement with the control cylinder. The apparatus further includes a sensor for detecting a temperature of at least one of the substrate media sheet and the ink deposited thereon. The thermal control element adjusts the temperature of the control cylinder in response to the temperature detected by the sensor. The control cylinder at least partially levels the ink while the sheet is held against the peripheral arch. The apparatus further includes a sheet process path for conveying the sheet. The acquisition nip holds the sheet along an intermediate portion of the process path on a first side of the acquisition nip. An exit portion of the process path is disposed on an opposed side of the acquisition nip relative to the intermediate portion. The apparatus further includes at least one controller operatively connected to and controlling the control cylinder, the thermal control element and the pressure roll.

According to further aspects described herein, there is disclosed a method of processing ink applied to substrate media sheets. The method including engaging a sheet of substrate media with a control cylinder rotatably supported along a process path of the sheet. The sheet conveys ink deposited on a first side thereof. The method further including rotating the control cylinder with the sheet held against a peripheral arch of the control cylinder as the control cylinder rotates with the first side of the sheet directly engaging and wrapping around the control cylinder along the peripheral arch. The method further including activating a thermal control element to at least one of heat and cool the control cylinder for thermal conduction to the sheet. The method further includes spreading the ink by passing the sheet between a pressure roll and the control cylinder. The pressure roll together with the control cylinder form a spreader nip. The spreader nip presses the ink on the sheet as it passes through the spreader nip and opens the spreader nip into an open position. The spreader nip is selectively changeable between a closed position and the open position. In the closed position the pressure roll is biased toward the control cylinder for applying pressure to the ink on the sheet. The pressure roll is spaced further away from the control cylinder in the open position relative to the closed position.

Additionally, the method including closing an acquisition nip disposed adjacent the spreader nip for holding the sheet after the sheet passes through the spreader nip. The control cylinder at least partially levels the ink while the sheet is held against the peripheral arch. The pressure roll moves out of the closed position after a trailing edge of the substrate media sheet disengages the pressure roll. A rotational velocity of the control cylinder is adjustable for regulating a dwell time in which the substrate media sheet remains in direct engagement with the control cylinder. The sheet is initially engaged by the control cylinder while the sheet is carried on a platen of a media cart. The method further including returning the sheet to the platen with the first side facing the platen. The method further including passing the sheet through spreader nip a second time while the spreader nip is in the open position. The method further including after passing the sheet through the spreader nip a second time, conveying the sheet further along the process path to a marking station for application of further ink to a second side of the sheet, the same marking station having previously applied the first side ink. The method further including re-engaging the sheet with the control cylinder after the application of the further ink to the second side of the sheet.

According to further aspects described herein, there is disclosed a system for processing ink applied to substrate media sheets. The apparatus includes a sheet transport including a sled having a platen for supporting thereon a sheet. The sled is translatable along a process path to transport the sheet to a control cylinder and to transport the sheet away from the control cylinder along the process path. The control cylinder is rotatably supported for thermal conduction to a sheet of substrate media. The sheet conveying ink is deposited on a first side thereof. The sheet is held against an arched portion of the control cylinder as the control cylinder rotates with the first side of the sheet directly engaging and wrapping around the control cylinder along the arched portion. The system further includes a thermal control element for at least one of heating and cooling the control cylinder. The system further includes a pressure roll for spreading the ink, the pressure roll together with the control cylinder forming a spreader nip. The spreader nip is selectively changeable between a closed position and an open position. In the closed position, the pressure roll is biased toward the control cylinder for applying pressure to the ink on the sheet, the pressure roll spaced further away from the control cylinder in the open position relative to the closed position.

DETAILED DESCRIPTION

Figure 1:
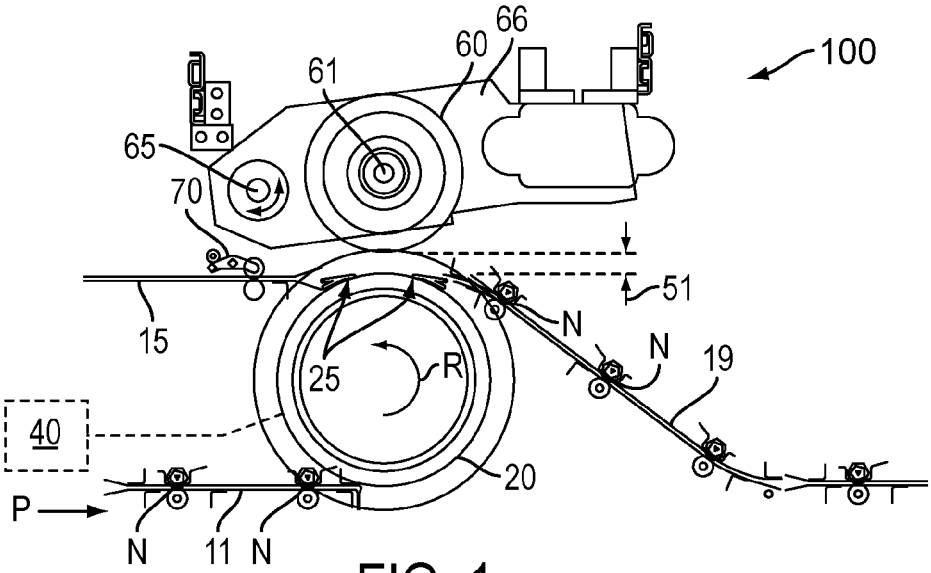
FIG. 1 is a side elevation view of an apparatus for processing ink applied to substrate media sheets in accordance with aspects of the disclosed technologies.

Describing now in further detail exemplary embodiments with reference to the Figures, as briefly described above.

As used herein, a "media handling assembly" refers to one or more devices used for handling and/or transporting substrate media, including feeding, marking, printing, finishing, registration and transport systems.

As used herein, a "marking device," "printer," "printing assembly" or "printing system" refers to one or more devices used to generate "printouts" or a print outputting function, which refers to the reproduction of information on "substrate media" for any purpose. A "marking device," "printer," "printing assembly" or "printing system" as used herein encompasses any apparatus, such as a digital copier, bookmaking machine, facsimile machine, multi-function machine, and the like, which performs a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction. Additionally, the "trailing edge" of a substrate media refers to an edge of the sheet that is furthest upstream in the process direction.

As used herein, "ink" refers to material for marking or creating an image on substrate media. Ink may be in liquid, gel, or solid form. The ink may change form during the printing process, e.g., solid to liquid. Solid ink may be in the form of colored sticks that can be melted for application to the substrate media.

As used herein, a "nip assembly", "nip assemblies" or simply a "nip" refers to an assembly of elements that include at least two adjacent revolving or recirculating elements and supporting structure, where the two adjacent revolving or recirculating elements are adapted to matingly engage opposed sides of a transfer belt or substrate media. A typical nip assembly includes two wheels or cylindrical rolls that cooperate to drive or handle a substrate therebetween. One or two of the opposing cylinders can include a driven cylinder, one or two of the opposing cylinders can be a freely rotating idler cylinder or the opposed cylinders can be a combination thereof. Together the two cylinders guide or convey the transfer belt or other substrate within a media handling assembly. More than two sets of mating cylinders can be provided in a laterally spaced configuration to form a nip assembly. It should be further understood that such cylinders are also referred to interchangeably herein as rolls or rolls. Once a substrate is engaged between the opposed revolving or recirculating elements, the space or gap between them is referred to as the "nip gap".

As used herein, "spreader nip" refers to assembly of elements that include at least two adjacent revolving or recirculating elements and supporting structure that apply pressure to substrate media to spread out ink deposited thereon.

As used herein, the terms "process" and "process direction" refer to a process of moving, transporting and/or handling an image or substrate media conveyed by a transfer belt. The process direction substantially coincides with a direction of a flow path P along which the image or substrate media is primarily moved within the media handling assembly. Such a flow path P is said to flow from upstream to downstream.

As used herein, "module" refers to each of a series of standardized units or subassemblies from which a printing system can be assembled. It should be understood that different modules can perform the same and/or different functions in the printing system, but are standardized to be selectively interconnected and operate together. A "transport module" is capable of moving substrate media through its own subassembly.

As used herein, "control cylinder" refers to a cylindrical to which substrate media is attached and which can regulate a property of the substrate media such as its temperature. The control cylinder may be in the form of a cylindrical drum or roller.

As used herein, "pressure roll" refers to a roller which forms part of a nip and which exerts a force on the substrate media.

As used herein, "thermal control element" refers to a device for regulating the temperature of another device, including one or more heating and or cooling elements that are disposed in or adjacent to the control cylinder. Heating elements may be in the form of electrical resistance coils, or tubing that permits heated fluid to flow there through in a controlled manner. Cooling elements may include tubing which allows cool fluid to flow there through in a controlled manner.

The disclosed technologies employ a solid ink print process which utilizes a wax-like solid ink. The ink is generally supplied in a solid form and melted into tiny droplets that are jetted onto a media through one or more piazo-electric ink jet head. As the ink droplets are deposited onto the substrate media sheet, they coalesce slightly but not necessarily uniformly. Thus, in order to achieve acceptable image quality, several more steps are required in order to achieve a desired uniformity. One initial step involves reducing the temperature of the droplets, as well as that of the substrate media, to a uniform temperature. This is often referred to as the cooling phase. It should be noted that the cooling phase requires a sufficient dwell time that the paper must remain in contact with the cooling roll. Dwell time generally refers to the amount of time the substrate media sheet remains in a region or in contact with a particular surface. After this initial cooling, the next step is often to bring both the substrate media sheet and the deposited ink back to a uniform temperature which often can involve heating and is thus referred to as a heating phase. As with the cooling phase, the heating phase requires a specific dwell time in order to ensure that the substrate media and the ink reach a uniform temperature. Thereafter, once the desired temperature is reached, the ink is ready for spreading which effectively evens out the distribution of the ink droplets for better image quality.

While all these steps are generally done in series, having to provide separate apparatus for each of these phases can be expensive and require significant maintenance. In accordance with aspects of the disclosed technologies, these functions can be combined into an integrated modular architecture. Doing so not only will reduce the cost by having fewer elements in a more compact design, but also means a more compact modular system can be distributed through different types of system architectures. For example, scaling problems generally occur when applying traditional marking methods to large cut-sheets of substrate media that are greater than 40×60 inches in size. However, aspects of the disclosed technologies can be scaled to work with such large cut-sheets which are more cumbersome and difficult to handle than smaller letter-size sheets of paper.

In accordance with aspects of the disclosed technologies, a set of cylinders or rolls acquire the substrate media sheet, used conduction heating or cooling to control the temperature of the sheet and ink deposited thereon and apply pressure as the sheet wraps around the main cylinder as well as further pressure when it passes through a nip assembly to spread the ink. Thereafter, the sheet motion is reversed and re-circulated in a process direction to enable a duplex function that is combined with the temperature and pressure applications all in one compact apparatus.

FIG. 1 shows an example of an apparatus 100 in accordance with aspects of the disclosed technologies. The apparatus includes a control cylinder 20 which is a drum-like structure rotatably supported along a process path P for handling sheets of substrate media. The sheets are conveyed along the process path P and upon reaching the control cylinder 20 is acquired by the control cylinder. The sheet is acquired by the control cylinder through the use of an internal vacuum, external nip rollers, paper edge grippers or other known means of maintaining a sheet held against an outer peripheral portion of a cylindrical drum. Once the leading edge or leading portions of the sheet are acquired by the control cylinder 20, the paper is held against the control cylinder as it rotates in a desired direction R, the sheet is thus made to wrap around the control cylinder until it passes between the control cylinder and a pressure roll 60. Together the control cylinder 20 and pressure roll 60 form a spreader nip. The pressure roll 60 is mounted to rotate about the center axis 61 and that center axis is preferably incorporated into a pivot arm mechanism 66. The pivot arm mechanism 66 is itself pivotally mounted about an offset axis 65 which allows the pressure roll to be selectively moved toward or away from the control cylinder 20. In this way, the spreader nip is selectively changeable between a closed position (FIG. 2) where the pressure roll 60 is biased towards the control cylinder 20 for applying pressure to a sheet passing therebetween, and an open position (FIG. 1) where a gap 51 is formed between the control cylinder 20 and the pressure roll 60. This gap 51 is also referred to as a nip gap. An acquisition nip 70 may be disposed adjacent to the spreader nip for holding a sheet after is passes through the spreader nip. The acquisition nip 70 is preferably placed as close as possible to the spreader nip so that immediately after the sheet has exited the spreader nip and is situated inside the acquisition nip, it can then be gripped by the acquisition nip. It should be understood that the acquisition nip 70, while shown as a single nip assembly, can actually comprise one or more additional nip assemblies which work in conjunction to grip the sheet in a position adjacent to the spreader nip assembly and can preferably move the sheet back through the spreader nip assembly after it is actuated into an open position.

Figure 2:
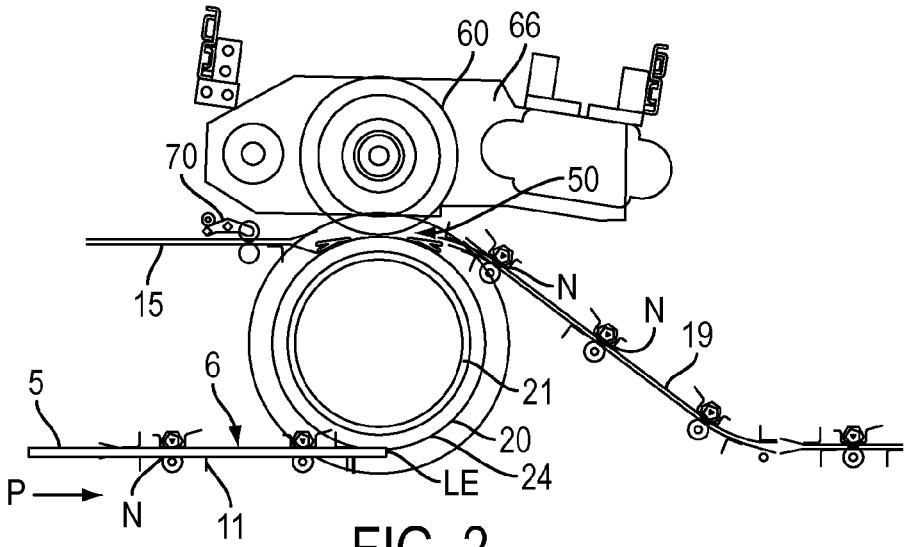
FIG. 2 is a side elevation view of the apparatus of FIG. 1 with a substrate media sheet initially engaging the apparatus in accordance with an aspect of the disclosed technologies.

FIGS. 2-6 illustrate a sheet of substrate media 5 being handled by the apparatus in accordance with aspects of the disclosed technologies. In particular, FIG. 2 shows a sheet 5 as it initially approaches and is engaged by the control cylinder 20. Prior to reaching the control cylinder 20, the sheet 5 progresses down a process path P having acquired ink 6 that is placed on a first side of the sheet 5. It should be understood that the process path P can have come from any number of earlier sheet handling stations including marking stations and other areas for treating and/or manipulating the substrate media sheet 5. The initial portion of the process path P prior to reaching the control cylinder 20 is indicated as an entry portion of the process path. Along various lengths of the process paths, smaller nip assemblies N can be used for maintaining control of the substrate media sheet 5 as it is moved thereon. Regardless, after the sheet progresses along the process path through the entry portion 11, it is then acquired by the control cylinder 20 and held there against.

The acquisition of the sheet 5 by the control cylinder 20 can be accomplished through a sheet acquisition apparatus 24 which may include the use of vacuum, additional nip rollers, paper edge grippers, air pressure, electrostatic retention methods or other known means. Depending on what means are used to maintain the sheet in contact with the control cylinder, such contact is desirable in order for thermal conduction to be affected from the control cylinder to the sheet 5 and the ink 6 carried thereon. Once acquired, the sheet 5 is held against the control cylinder 20 long enough to actively sense the temperature of the sheet 5 and possibly the ink 6 thereon, as well as heat and/or cool the cylinder as needed. The duration that the sheet or portions thereof are in contact with the control cylinder is referred to herein as the "dwell time" of any particular portion of the sheet. During the time that segments of the sheet 5 are in direct contact with the control cylinder 5, the temperature of the cylinder will transfer by conduction to the sheet and the ink thereon. In this way, if the control cylinder is hotter than the sheet 5 and/or the ink 6, such heat will be transferred to those elements. Similarly, the control cylinder can be cooled to thereby draw heat from the sheet 5 or the ink 6 thereon. This system avoids the need for convective or radiant heating which is less efficient and can require more space. Also, by combining the functions of thermal control as well as leveling and spreading of the ink on the substrate media sheet, the dwell time needed for the sheet can be reduced and the size of the heating cooling spreading device is minimized. Further, power requirements for this system can be reduced by this more efficient design. Also, the dwell time of the sheet or portions thereof can be tightly controlled and optimized by correctly choosing the size and velocity of the control cylinder 20.

A thermal control element 21 (FIG. 2) may include one or more heating and or cooling elements that are disposed in or adjacent to the control cylinder. Heating elements may be in the form of electrical resistance coils, or tubing that permits heated fluid to flow there through in a controlled manner. Cooling elements may include tubing which allows cool fluid to flow there through in a controlled manner, or application of thermal electric cooling (TEC) devices.

As shown in FIG. 2, the sheet 5 reaches the entry position 11 at least initially with ink 6 deposited on one side of the sheet. In a duplex printing environment, the initial pass will have the first side conveying the ink facing the control cylinder. It should be noted that while the nip gap is shown in a closed position 50, it need not be closed until the sheet reaches the nip.

Figure 3:
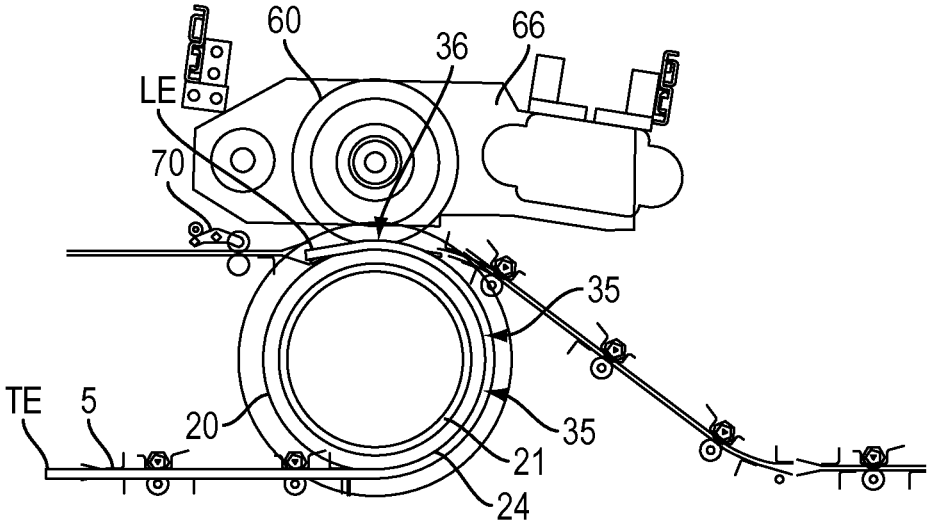
FIG. 3 is a side elevation view of the apparatus of FIG. 1 with the substrate media sheet held against a peripheral arch of the control cylinder in accordance with aspects of the disclosed technologies.
Figure 4:
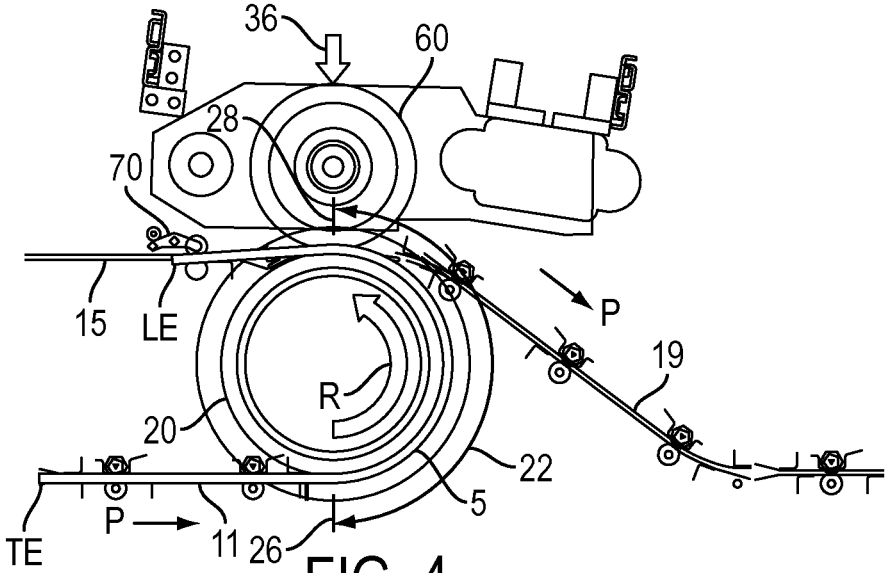
FIG. 4 is a side elevation view of the apparatus of FIG. 1 with the substrate media sheet having reached an acquisition nip in accordance with aspects of the disclosed technologies.

FIG. 3 shows the sheet 5 having progressed further around the control cylinder 20. As the sheet is wrapped around the control cylinder 20 forces 35 are applied which maintains in contact with the control cylinder as noted above. As it wraps around the control cylinder the sheet 5 is made to pass between the pressure roll 60 and the control cylinder 20, together which form the spreader nip. The spreader nip applies a further pressure 36 to the sheet 5 as well as the ink 6 deposited thereon. As shown in FIG. 4, the sheet 5 is made to travel around a peripheral arch 22 of the control cylinder 20. The arch extends from a first point 26 of the control cylinder around to a second point 28 of the control cylinder taking the sheet from the entry portion 11 to the intermediate portion 15 of the process path. FIG. 4 also shows the leading edge of the sheet extending slightly pass the spreader nip and has reached the acquisition nip 70. Acquisition nip 70 should be disposed closely adjacent to the spreader nip as shown in the drawings.

Figure 5:
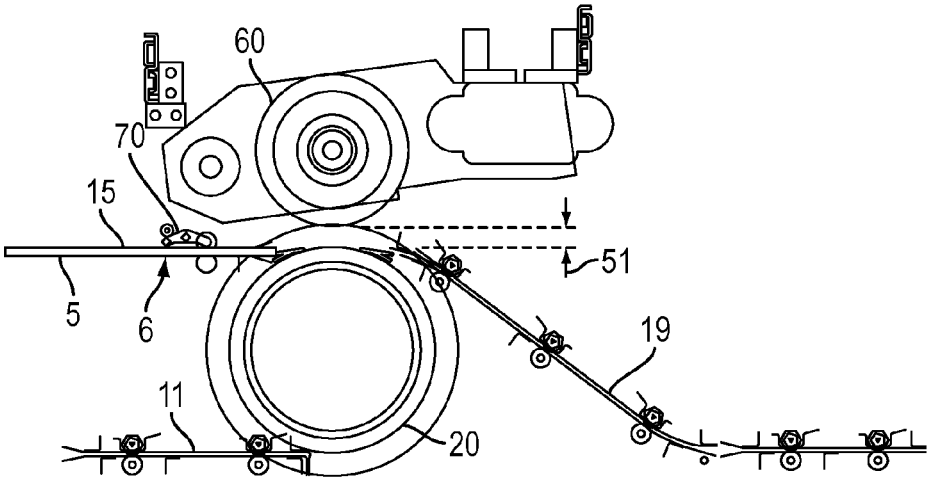
FIG. 5 is a side elevation view of the apparatus of FIG. 1 with the substrate media sheet having disengaged from the control cylinder in accordance with aspects of the disclosed technologies.
Figure 6:
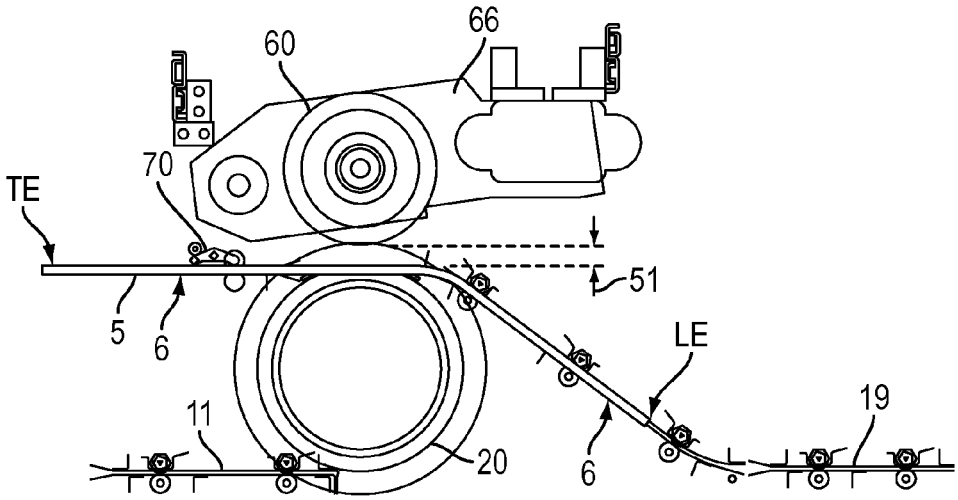
FIG. 6 is a side elevation view of the apparatus of FIG. 1 with the substrate media sheet passing back through the spreader nip in an open position in accordance with aspects of the disclosed technologies.

As shown in FIG. 5, the sheet should eventually pass completely through the spreader nip, so that the trailing edge of the sheet 5 has exited the spreader nip and is now held by acquisition nip 70. During this point in the process, the sheet is held in the intermediate portion 15 of the process path. This intermediate portion of the process path 15 is often referred to as an over run tray. Once the sheet 5 has exited the spreader nip, the spreader nip can be opened. In this way, the spreader arm 66 pivots the spreader arm so that the pressure roll 60 moves away from the control cylinder 20 as shown in FIGS. 5 and 6, thus forming a nip gap 51. In accordance with one aspect of the disclosed technologies, the sheet handling system is designed for large sheet architecture. Accordingly, a large cam system or hydraulics would be employed to quickly and accurately open and close the nips. Once the spreader nip is opened, the sheet 5 will be made to once again pass in between the control cylinder and the pressure roll. However, on this path the sheet need not be engaged by both the control cylinder and the pressure roll. Alternatively, the pressure roll can once again be closed for applying additional pressure to the sheet and the ink, however, in this case the acquisition nip 70 should be opened while the spreader nip is closed in order to avoid binding or tearing of the sheet. As the sheet 5 is sent back through the spreader nip wrap, rather than wrapping itself around the control cylinder again, it is preferably sent along a different path through the exit portion 19 of the process path. Thus, as shown in FIG. 6, the trailing edge and leading edge of the sheet has now changed so what used to be the trailing edge now becomes the leading edge and vice versa. It also should be noted in FIG. 6 that this process has now inverted the sheet since the ink 6 is now facing downward whereas in the initial approach the ink was facing upward.

Figure 7:
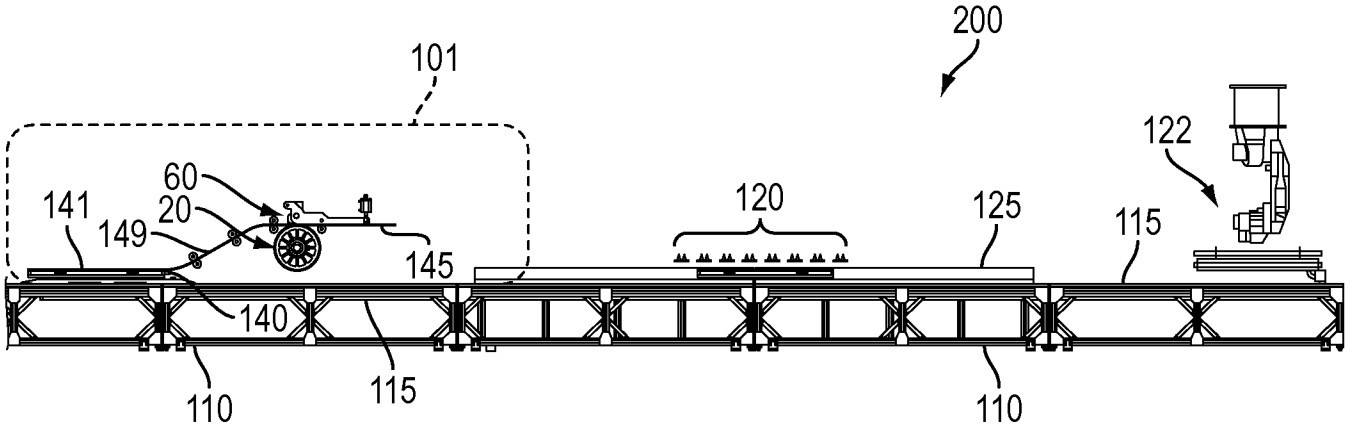
FIG. 7 is a side elevation view of a large-sheet handling track with a loading marking and inversion station in accordance with aspects of the disclosed technologies.
Figure 8:
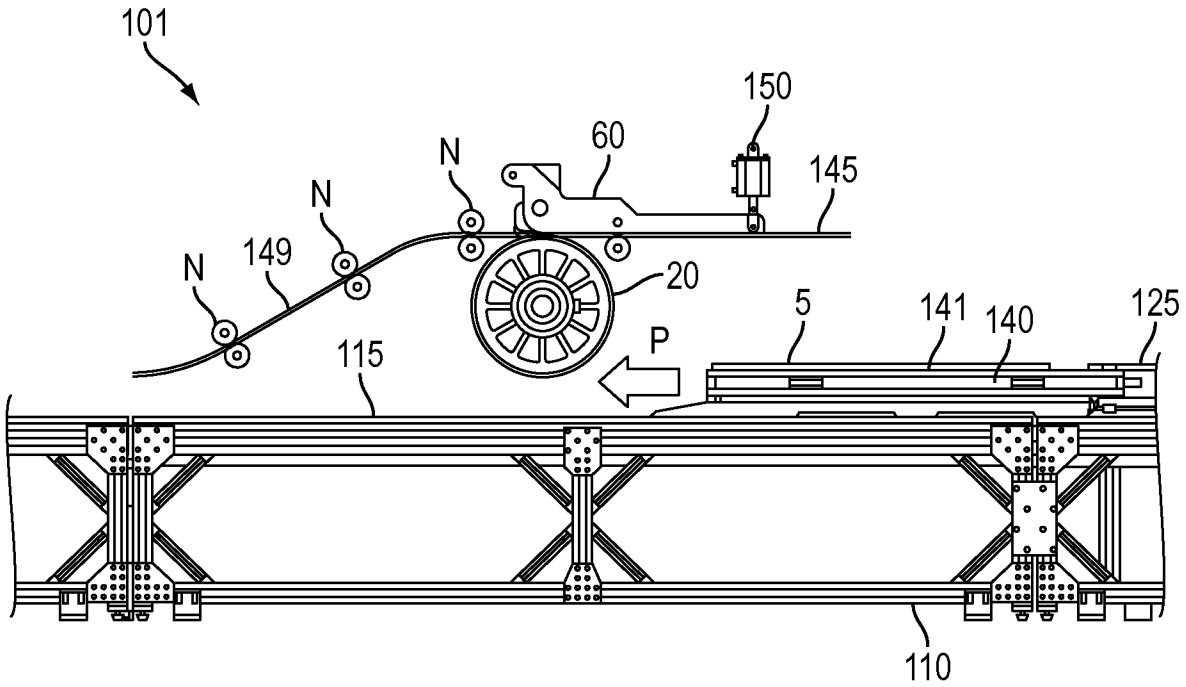
FIG. 8 shows a side elevation view of the apparatus of FIG. 7 showing a media cart approaching a control cylinder in accordance with aspects of the disclosed technologies.

FIG. 7 shows an alternative embodiment which incorporates the apparatus for processing ink to a flat bed sled architecture. The apparatus 200 includes a support structure 110 for a track 115. The track 115 supports and guides a sled 140. The sled may be in the form of a media cart 140 that translates along various positions from the track from a loading station 122 through a marking station 120 which has a lateral guide wall 125 and then to the post application ink processing station 101.

Figure 9:
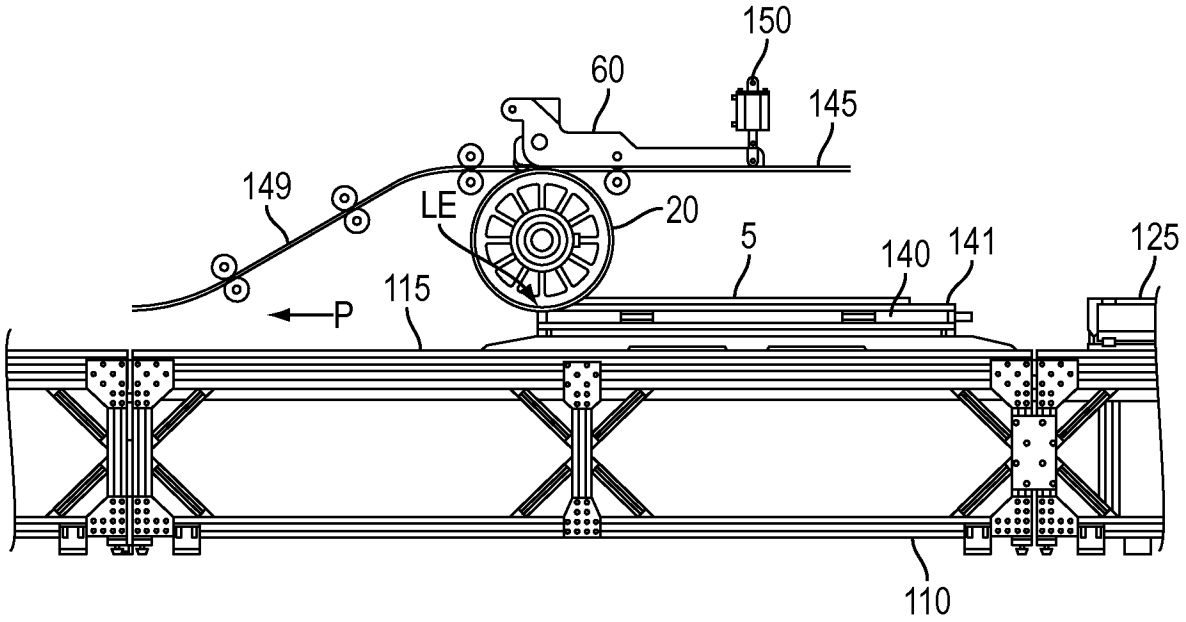
FIG. 9 shows a side elevation view of the apparatus of FIG. 7 showing a media cart initially engaging the control cylinder in accordance with aspects of the disclosed technologies.

FIGS. 8-11 show a step by step process as the media cart 140 passes through the post application processing station 101. The media cart 140 includes a platen 141 for holding the substrate media sheet 5 flat thereon. The media cart 140 travels along the track 115 in a process direction P. Thus, the sheet held on the platen 141 would be carrying ink deposited at the marking station 120 (FIG. 7). This untreated ink resting on the top side of the sheet still needs to be leveled and spread. FIG. 9 shows the media cart having reached the control cylinder 20. Also, the leading edge LE of the sheet should be engaged and acquired by the control cylinder 20 at about this time. As in the previous embodiments, the control cylinder 20 may include a sheet acquisition apparatus, such as clippers or vacuum suction to acquire the sheet 5 from platen 141. Alternatively, the sheet acquisition apparatus may include an electrostatic force to draw the sheet 5 off the platen 141 so that it can wrap around the control cylinder 20.

Figure 10:
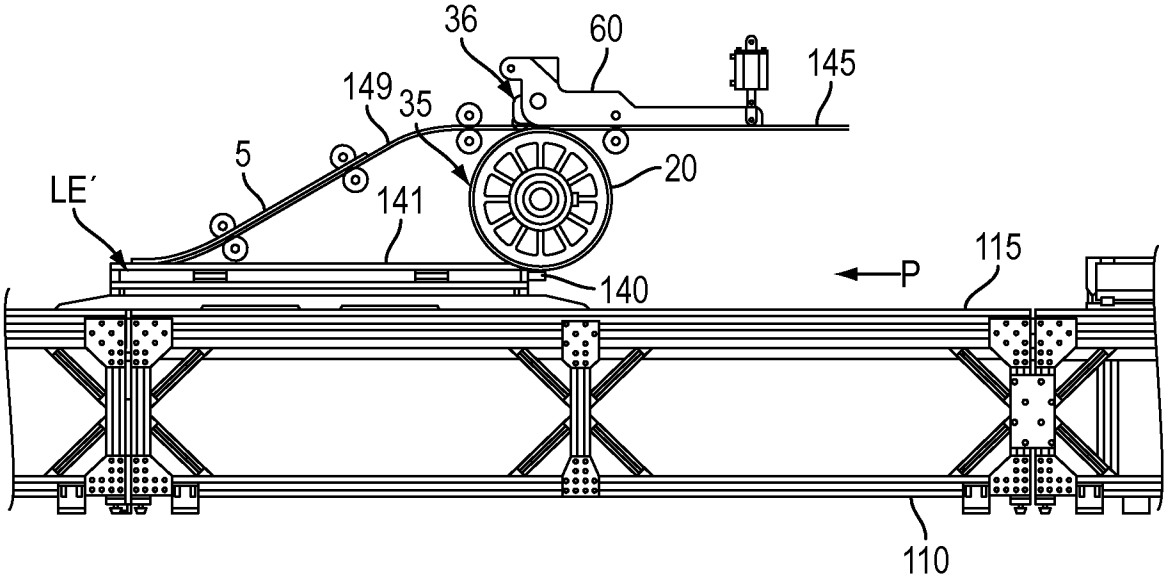
FIG. 10 shows a side elevation view of the apparatus of FIG. 7 showing a media cart disengaging the control cylinder in accordance with aspects of the disclosed technologies.
Figure 11:
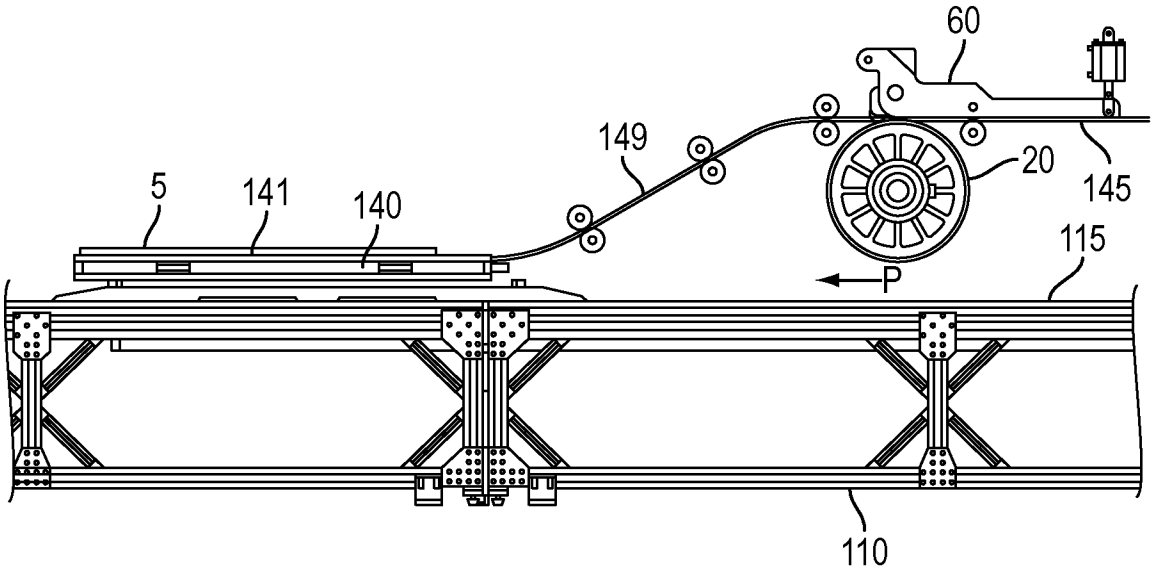
FIG. 11 shows a side elevation view of the apparatus of FIG. 7 showing a media cart downstream of the control cylinder in accordance with aspects of the disclosed technologies.

FIG. 10 shows the media cart 140 having progressed so that its trailing edge is just about to disengage from the control cylinder 20. Preferably at this time, the substrate media sheet 5 has wrapped around the control cylinder 20 and pass between the control cylinder and the pressure roll 60 in order to level and spread the ink. The pressure 35 of the sheet wrapped around the cylinder 20 helps level the ink while the additional pressure 36 applied by the spreader nip can spread the ink more evenly. Pressure 36 may be applied by actuator 150 (FIG. 9). The actuator 150 may be in the form of a pneumatic, hydraulic, or electromechanical linear actuator. Movement of the actuator selective applies and releases the pressure of the pressure roll 60. Thereafter, the substrate media sheet is backed onto the over run tray 145. Also, the media cart 140 has progressed further down the process path so that it is ready to reacquire the sheet as it reverses direction and passes back through an open spreader nip. The sheet travels down the exit path 149 and now has a new leading edge LE' which used to be the sheets trailing edge before passing through the sheet inversion process. By the time the media cart 140 reaches the end of the exit path 149, the new trailing edge of the sheet should be timed to arrive and would acquire its position on the platen 141. In this way, the cut sheet is re-acquired by the media cart 140 with the ink side now facing the platen 141. Thus, the clean side of the sheet now faces up and can proceed to the marking station for duplex processing. Alternatively, the sheet can proceed for further handling such as unloading, additional surface treatments, folding or other known substrate media processing stations.

Figure 12:
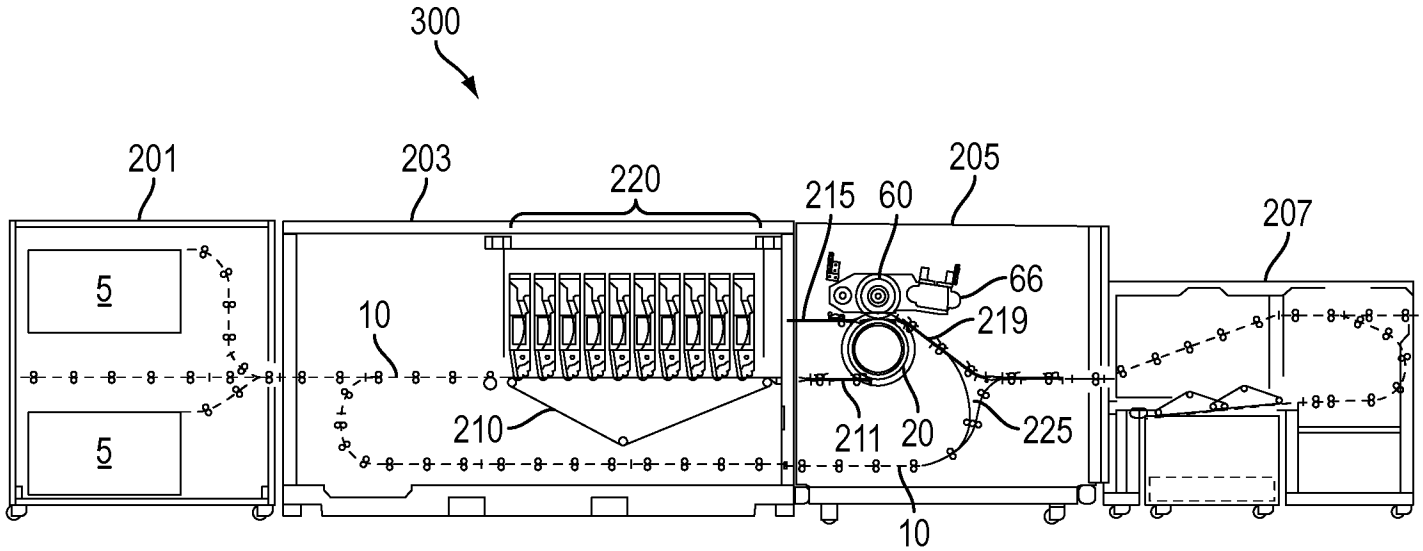
FIG. 12 is a side elevation view of an apparatus for processing ink applied to substrate media sheets in a modular environment incorporated into a printing system in accordance with aspects of the disclosed technologies.

FIG. 12 shows yet a further aspect of the disclosed technologies which includes a printing system 300. The printing system shown includes a modular design. Preferably such modules are somewhat interchangeable so that modules can be removed and/or added as needed. The printing system 300 includes loading trays 201 which apply the substrate media sheets 5. The joining module includes the marking module 203 which includes the marking station 220. The sheets 5 travel on the process path 10 and get held against the transport belt 210 as the solid ink is applied at the marking station 220. Once the ink is applied, the sheet travels to the next module which includes the post application ink processing module 205. As above, this module includes a control cylinder 20 and pressure roll 60 controlled by the control arm 66. The sheet 5 moves along the entry path 211, wraps around the control cylinder 20 through the spreader nip and is held in the intermediate path portion 215 (over run tray). After passing through the spreader nip, the sheet reverses direction and exits through the exit path 219. For single sided printing, the sheet can then proceed to the final processing module 207 for further processing, registration, stacking or other known processes. Alternatively, for duplex printing, the sheet travels down the exit portion 219 of the process path but then the gate mechanism 225 can redirect the sheet back along the process path 10 so it will once again return to the marking station 220.

Often media handling assembly, and particularly printing systems, include more than one module or station. Accordingly, more than one post-application ink processing apparatus as disclosed herein can be included in an overall media handling assembly. Further, it should be understood that in a modular system or a system that includes more than one post-application ink processing apparatus, in accordance with the disclosed technologies herein, could detect sheet position or other sheet characteristics and relay that information to a central processor for controlling registration or speed, including dwell time on the control cylinder. Thus, if additional leveling and spreading is needed or simply further sheet inversion, the apparatus and methods described herein could be employed to achieved the desired sheet handling, for example in another module or station.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. An apparatus for processing ink applied to substrate media sheets, the apparatus comprising:

a control cylinder rotatably supported for thermal conduction to a sheet of substrate media, the sheet conveying ink deposited on a first side thereof, the sheet being held against a peripheral arch of the control cylinder as the control cylinder rotates with the first side of the sheet directly engaging and wrapping around the control cylinder along the peripheral arch, a rotational velocity of the control cylinder adjustable for regulating a dwell time in which the sheet of substrate media sheet remains in direct engagement with the control cylinder;

a thermal control element for heating or cooling the control cylinder via cooling fluid or a thermal electric cooling device while holding the media sheet in direct contact with the control cylinder, heating or cooling the media sheet via adjustment of the dwell time of the sheet of substrate media; and a pressure roll for spreading the ink, the pressure roll together with the control cylinder forming a spreader nip, the spreader nip selectively changeable between a closed position and an open position, in the closed position the pressure roll being biased toward the control cylinder for applying pressure to the ink on the sheet, the pressure roll spaced further away from the control cylinder in the open position relative to the closed position, wherein the dwell time is regulated by controlling the velocity of the control cylinder such to allow the sheet to be held against the control cylinder long enough for a sensor to actively sense a temperature of the sheet and heat or cool the sheet, as needed, to a uniform temperature.

2. The apparatus of claim 1, further comprising:

an acquisition nip disposed adjacent the spreader nip for holding the sheet after the sheet passes through the spreader nip.

3. The apparatus of claim 2, wherein the acquisition nip moves the sheet at least partly through the spreader nip in the open position, the acquisition nip including one or more additional nip assemblies which work in conjunction to grip the sheet, wherein each nip and each additional nip assembly comprises at least two adjacent revolving or recirculating elements and supporting structure.

4. The apparatus of claim 1, wherein the pressure roll moves away from the control cylinder after a trailing edge of the substrate media sheet disengages the pressure roll, allowing the substrate media sheet to pass between the pressure roll and the control cylinder without further engaging the pressure roll.

5. The apparatus of claim 1, further comprising:

a sensor for detecting a temperature of the ink deposited on the substrate media sheet by holding the substrate media sheet against the control cylinder.

6. The apparatus of claim 5, wherein the thermal control element adjusts the temperature of the control cylinder in response to the temperature detected by the sensor.

7. The apparatus of claim 6, wherein the thermal control element includes for heating the control cylinder one or more electrical resistance coils or tubing permitting a heated fluid to flow and a heated fluid.

8. The apparatus of claim 1, wherein the control cylinder at least partially levels and spreads the ink while the sheet is held against the peripheral arch.

9. The apparatus of claim 1, further comprising:

a sheet process path for conveying the sheet, the acquisition nip holding the sheet along an intermediate portion of the process path on a first side of the acquisition nip, an exit portion of the process path being disposed on an opposed side of the acquisition nip relative to the intermediate portion, the exit portion being a different path to change a leading edge of the sheet into a trailing edge and invert the sheet.

10. The apparatus of claim 1, further comprising:

at least one controller operatively connected to and controlling the control cylinder, the thermal control element and the pressure roll.

11. The apparatus of claim 1, wherein the control cylinder acquires the sheet of substrate media via a sheet acquisition apparatus utilizing selectively one of following: vacuum, paper edge grippers, air pressure, and electrostatic retention.

12. The apparatus of claim 1, wherein the spreader nip changes between the closed position and the open position via utilization of a hydraulic system.

13. The apparatus of claim 1, wherein the pressure roll is associated with an actuator and movement of the actuator selectively applies and releases pressure of the pressure roll, the actuator in a form of a pneumatic or a hydraulic linear actuator.

14. A method of processing ink applied to substrate media sheets, the method comprising:

engaging a sheet of substrate media with a control cylinder rotatably supported along a process path of the sheet, the sheet conveying ink deposited on a first side thereof, the sheet initially engaged by the control cylinder while the sheet is carried on a platen of a media cart;

rotating the control cylinder with the sheet held against a peripheral arch of the control cylinder as the control cylinder rotates with the first side of the sheet directly engaging and wrapping around the control cylinder along the peripheral arch, a rotational velocity of the control cylinder adjustable for regulating a dwell time in which the sheet of substrate media remains in direct engagement with the control cylinder;

activating a thermal control element to heat or cool the control cylinder for thermal conduction to the sheet while holding the media sheet in direct contact with the control cylinder, heating or cooling the media sheet via adjustment of the dwell time of the sheet of substrate media;

spreading the ink by passing the sheet between a pressure roll and the control cylinder, the pressure roll together with the control cylinder forming a spreader nip, the spreader nip pressing the ink on the sheet as it passes through the spreader nip; and opening the spreader nip into an open position, the spreader nip being selectively changeable between a closed position and the open position, in the closed position the pressure roll being biased toward the control cylinder for applying pressure to the ink on the sheet, the pressure roll spaced further away from the control cylinder in the open position relative to the closed position, wherein the dwell time is regulated by controlling the velocity of the control cylinder such as to allow the sheet to be held against the control cylinder long enough for a sensor to actively sense a temperature of the sheet and heat or cool the sheet, as needed, to a uniform temperature.

15. The method of claim 14, further comprising:

closing an acquisition nip disposed adjacent the spreader nip for holding the sheet after the sheet passes through the spreader nip.

16. The method of claim 14, wherein the control cylinder at least partially levels and spreads the ink while the sheet is held against the peripheral arch.

17. The method of claim 14, wherein the pressure roll moves out of the closed position after a trailing edge of the substrate media sheet disengages the pressure roll.

18. The method of claim 14, further comprising:

returning the sheet to the platen with the first side facing the platen.

19. The method of claim 14, further comprising:

passing the sheet through spreader nip a second time while the spreader nip is in the open position.

20. The method of claim 19, further comprising:

after passing the sheet through the spreader nip a second time, conveying the sheet further along the process path to a marking station for application of further ink to a second side of the sheet, the same marking station having previously applied the first side ink.

21. The method of claim 20, further comprising:

re-engaging the sheet with the control cylinder after the application of the further ink to the second side of the sheet.

22. The apparatus of claim 14, wherein the thermal control element further includes for cooling the control cylinder cooling fluid and tubing permitting a cooling fluid to flow.

* * * * *